US006085365A

United States Patent [19]

Chiang

[11] Patent Number: 6,085,365

[45] Date of Patent: Jul. 11, 2000

[54] STRUCTURALLY IMPROVED TOILET

[76] Inventor: Feng-I Chiang, NO.56, Min Sheng Street, Feng-Yuan City 42041, Taiwan

[21] Appl. No.: 09/336,380

[22] Filed: Jun. 15, 1999

[51] Int. Cl.[7] ..... E03D 11/00

[52] U.S. Cl. ..... 4/420; 4/234; 4/237

[58] Field of Search ..... 4/420, 300.3, DIG. 5, 4/421, 234, 237

[56] References Cited

U.S. PATENT DOCUMENTS

| | | | |
|---|---|---|---|
| 912,754 | 2/1909 | Storer | 4/421 |
| 2,099,118 | 11/1937 | Kennedy | 4/420 |
| 2,185,887 | 1/1940 | Dennis | 4/DIG. 5 X |
| 2,853,713 | 9/1958 | Mello | 4/421 |
| 3,680,154 | 8/1972 | Stairs | 4/420 |

FOREIGN PATENT DOCUMENTS

| | | | |
|---|---|---|---|
| 27312 | 11/1895 | United Kingdom | 4/420 |

*Primary Examiner*—Charles E. Phillips

[57] ABSTRACT

A structurally improved toilet is provided. The toilet includes a bowl having a urine protector at front end, an opening, a transverse extension from a sloped partition in a water reservoir inside the bowl so as to define a shallow water portion thereon and a saddle portion abutting the front end, and a seat assembly which is comprised of a seat and cover hinged with each other on their rear end, each has an upright and a saddle portion respectively engaging with the urine protector and the saddle portion of the bowl. This disclosure is characterized in that the user will be comfortable to sit on the toilet, the water will not splash on the buttock of the user and the urine of the user will not splash out of the bowl.

1 Claim, 5 Drawing Sheets

STRUCTURALLY IMPROVED TOILET

BACKGROUND OF THE INVENTION

The present invention relates to water closet and more particularly to a structurally improved toilet which provide a saddle shaped toilet seat and shallow water portion above a transverse extension in the bowl so as to correspond to the ergonomics and to prevent the water in the bowl from splashing on the buttock of the users.

Typical toilet as shown in FIG. 5 includes a toilet bowl 30 and a water reservoir 30 in the bottom of the bowl 30. When a user sits on the toilet seat, his buttock positions directly above the water reservoir 31. So that the water must splash his buttock when the excrement drops down. If the user is a male whose urine is usually directed to forward so that the urine may splash the toilet seat or his pants.

SUMMARY OF THE PRESENT INVENTION

The present invention has a main object to provide a structurally improved toilet which has a shallow water portion above a transverse extension in the toilet bowl in order to prevent the water from splashing the user's buttock when the excrement drops down.

Another object of the present invention is to provide a structurally improved toilet which has a saddle shape toilet seat to correspond the ergonomics in order to provide the users the comfortable feelings.

Still another object of the present invention is to provide a structurally improved toilet which has a urine protector at the front of the toilet bowl for preventing the urine from splashing out of the bowl.

A further object of the present invention is to provide a structurally improved toilet which the seat has an odor protection part to prevent the odor from diffusing out of the bowl.

The present invention will become more fully understood by reference to the following detailed description thereof when read in conjunction with the attached drawings.

DETAILED DESCRIPTION OF THE PREFERRED EMBODIMENT

Figure 1:
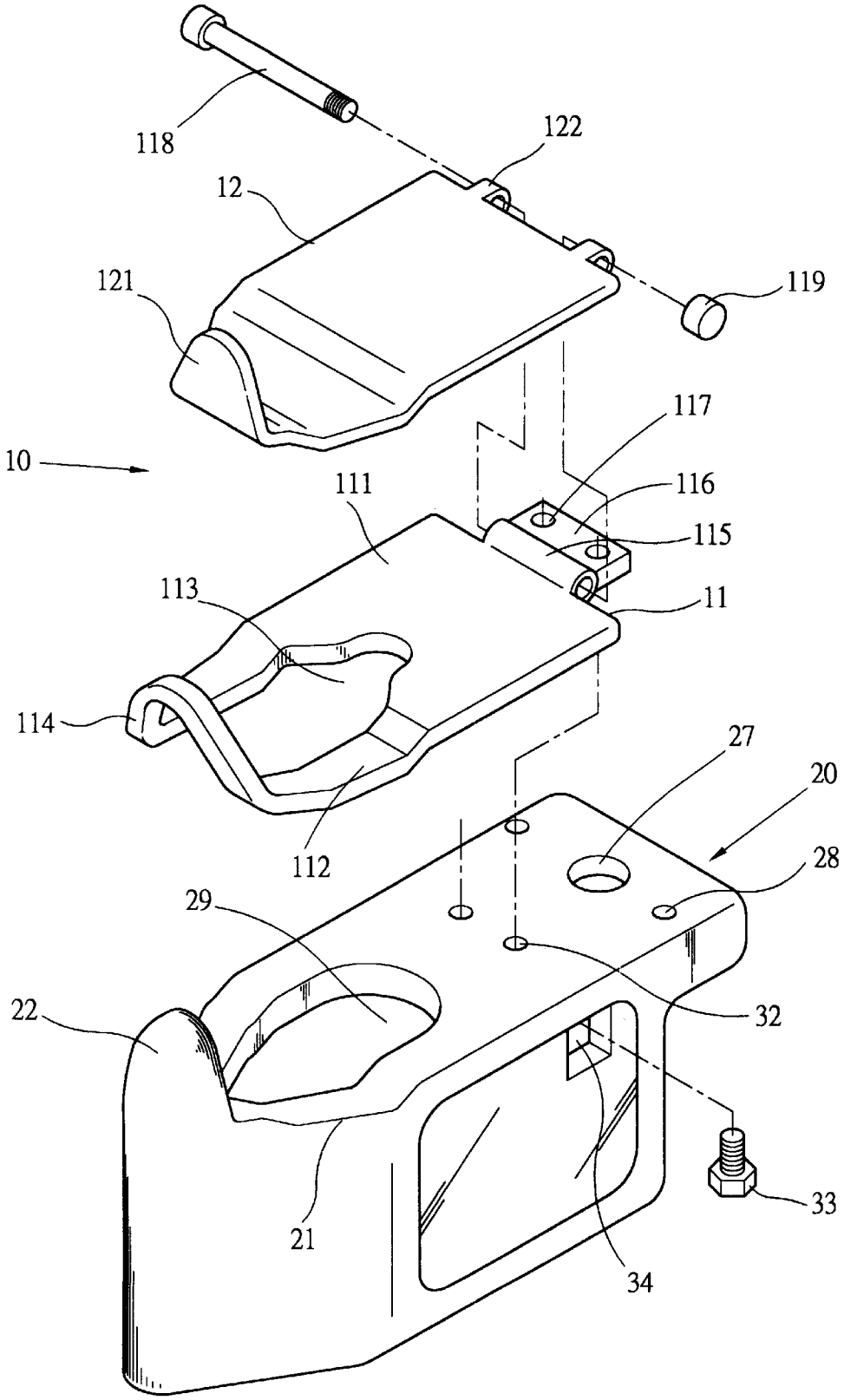
FIG. 1 is an exploded perspective view to show the preferred embodiment of the present invention.
Figure 2:
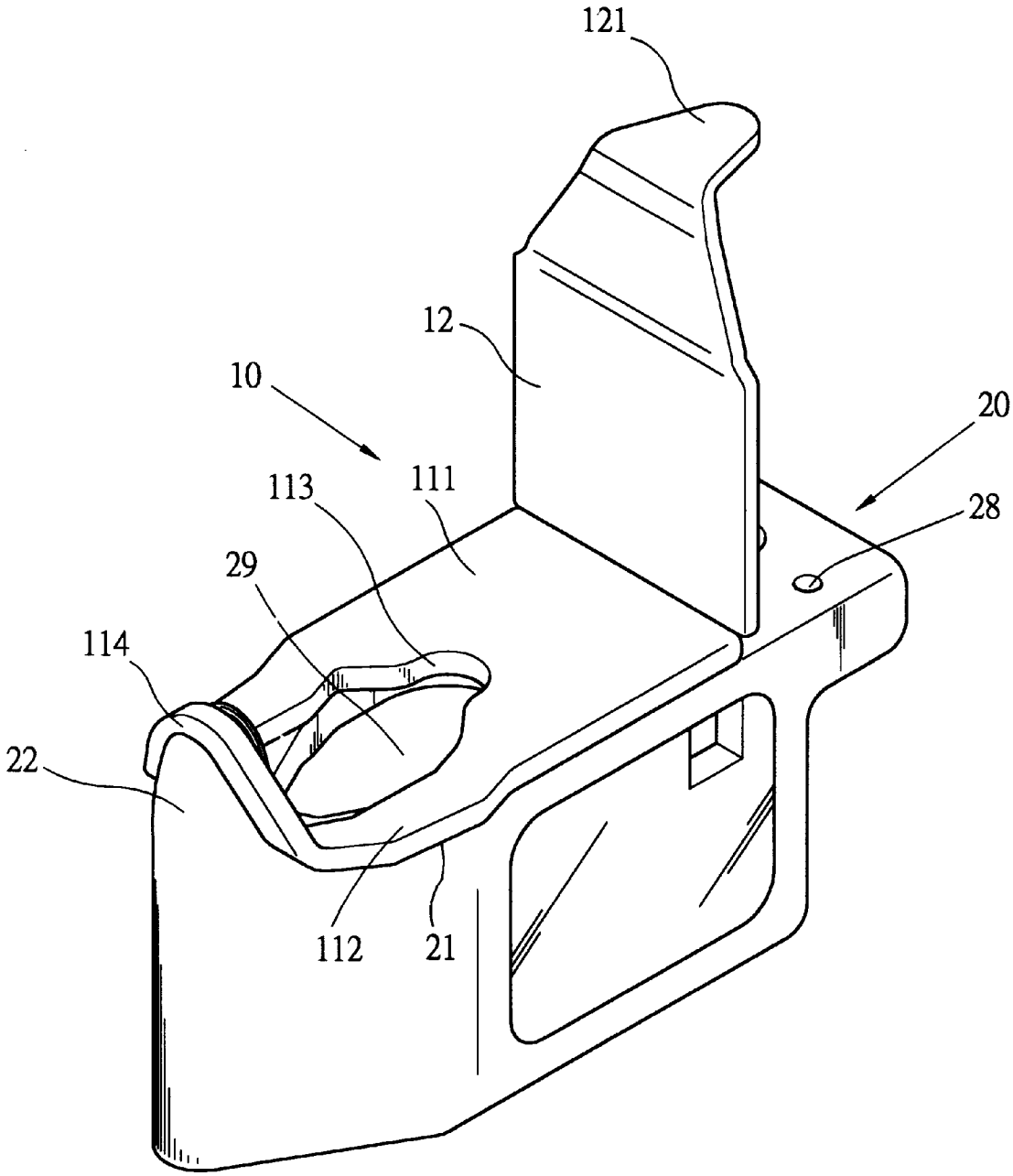
FIG. 2 is an perspective view to show the assemblage of the preferred embodiment of the present invention.
Figure 3:
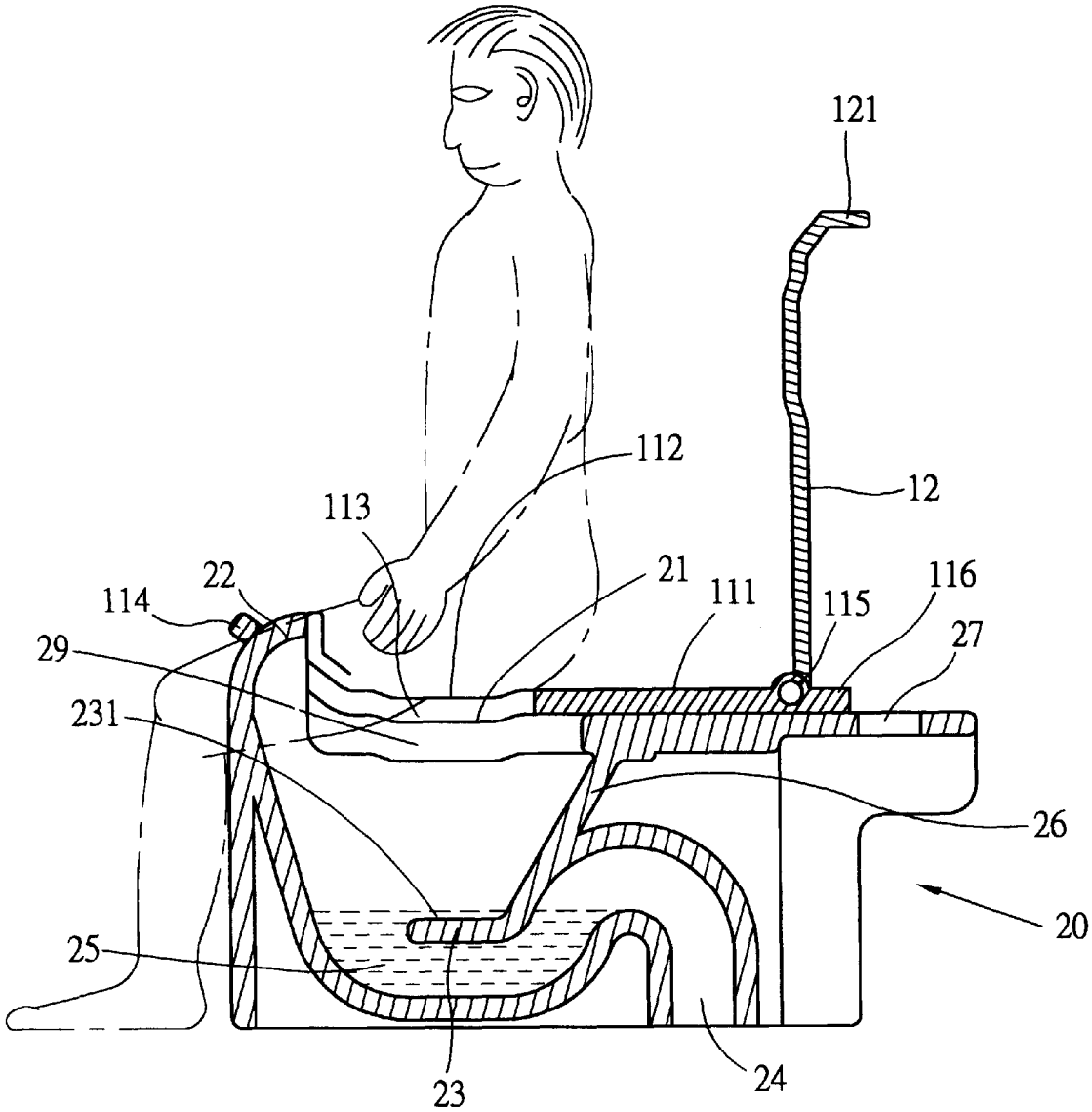
FIG. 3 is a sectional view of FIG. 2 illustrating a user sitting on the toilet.
Figure 4:
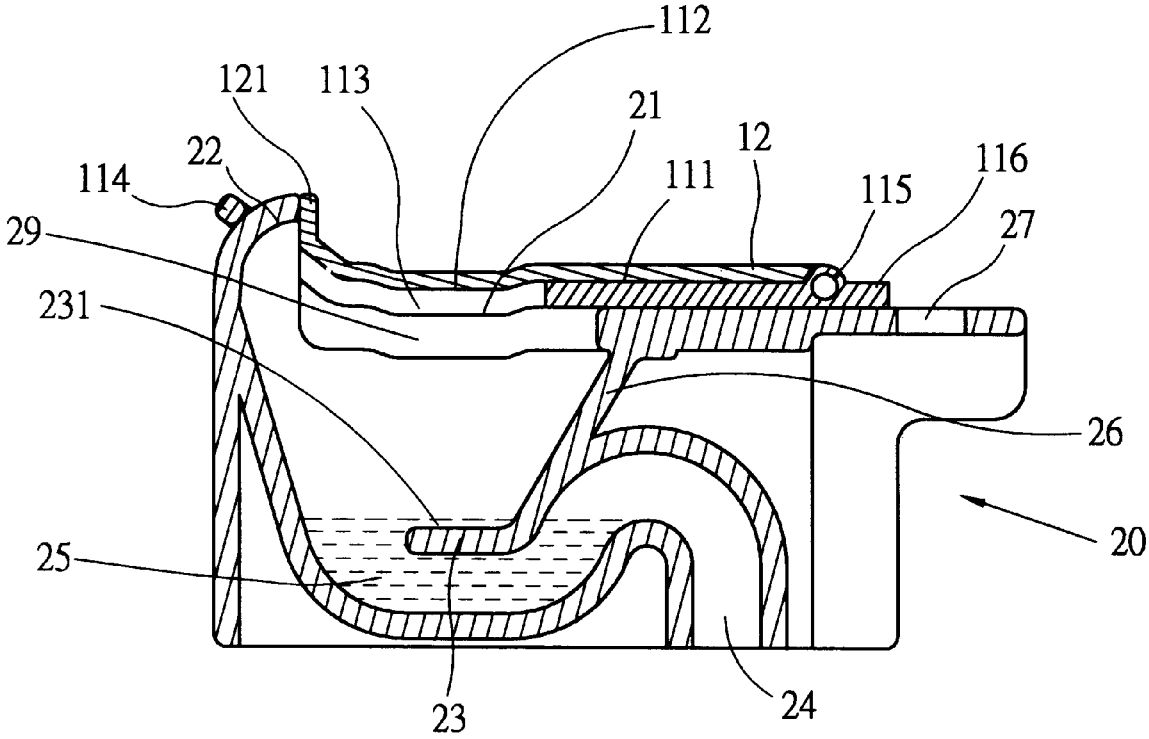
FIG. 4 is a sectional view of FIG. 2 indicating that the seat is closed.
Figure 5:
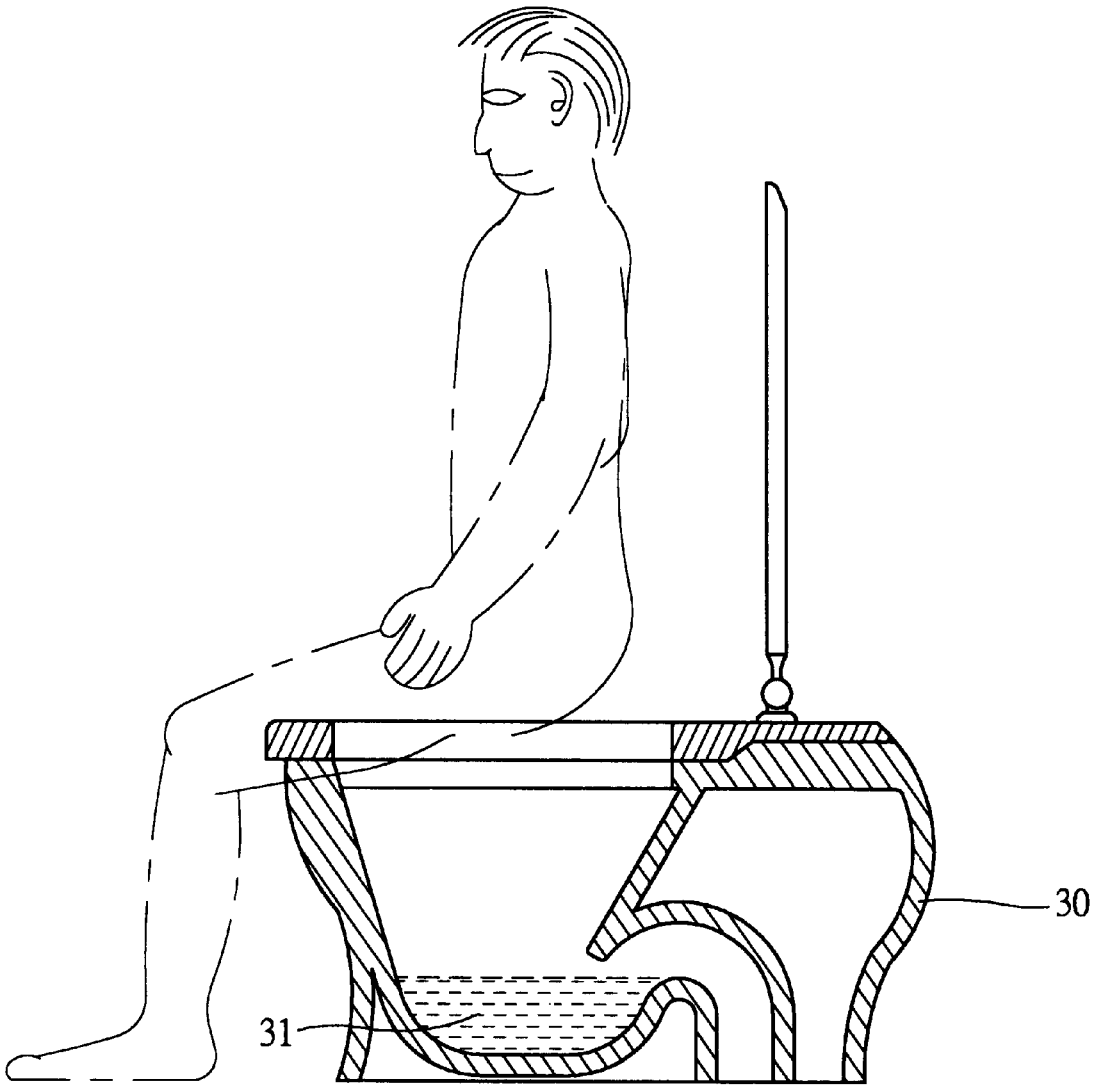
FIG.5 Prior Art
FIG. 5 is a sectional view to shows a toilet of the prior art.

With reference to FIGS. 1 to 4 of the drawings, the structurally improved toilet of the present invention comprises generally a seat assembly 10 and a toilet bowl 20.

The toilet bowl 20 includes a closed top, a first saddle, a urine protector 22, a transverse extension 23 extending forward from a sloped partition 26 and in the water reservoir 25 so as to define a shallow water portion 231 thereon, a water inlet 27 in the rear portion of the bowl communicating to a valve seat of a water tank (not shown), a pair of first fastening holes 28 for securing the water tank, a drain pipe 24 under the bowl 20 communicating to the water reservoir 25 and an upper opening 29 abutting the urine protector 22, The seat assembly 10 is comprised of a toilet seat 11 and a cover 12. The seat 11 includes an odor protection part 111, a second saddle portion 112 engageable with the first saddle portion 21 of the bowl 20, a first upright 114 projected upward from the front end engageable with the urine protector 22 of the bowl 20, an opening engageable with the upper opening 29 of the bowl 20, a knuckle 115 member centrally formed at the rear end of the seat 11 and a positioning plate 116 extending outward from the knuckle member 116 in which is a pair of screw holes 117. The cover 12 includes a second upright 121 projected upwardly from the front end engageable with the first upright 114 of the seat seat 11, a pair of lugs 122 extending spaced apart from the rear end for hinging the cover 12 to the knuckle member 115 of the seat 11 by a threaded pin 118 and a nut 119 and a third saddle portion abutting the second upright 121. The seat assembly 10 is then secured to the toilet bowl 20 through the screw holes 117 of the positioning plate 116 and the securing holes 32 of the bowl 20 by bolts 33 via the window 34.

In use, the user sits on the seat 11 just like riding on a horse, when the excrement drops on the shallow water portion 231, neither the water splashes on the buttock of the user because the short distance, nor the excrement contaminates the traverse extension 23 because of the shallow water on its surface. Besides, the closed top of the bowl 20 prevents the odor from diffusing out of the bowl 20. If the user is a male, his urine will be prevented by the urine protector 22 from splashing out of the bowl 20.

The specification relating to the above embodiment should be construed as exemplary rather than as limitative of the present invention, with many variations and modifications being readily attainable by a person of average skill in the art without departing from the sprit or scope thereof as defined by the appended claims and their legal equivalents.

I claim:

1. A structurally improved toilet comprising:

a bowl having a front end, a rear end, a closed top, a hollow interior, a urine protector projected upward from the front end, an opening and a first saddle portion in the closed top abutting the urine protector, a water inlet centrally formed in the proximity of the rear end communicating with the hollow interior and a water tank, a pair of first fastening holes formed spaced apart on lateral sides of the water inlet for securing the water tank, a pair of securing holes spaced apart in the closed top between the opening and the water inlet, a water reservoir in bottom of said bowl, a window in a side wall of said bowl, a sloped partition in a rear portion of the hollow interior and a transverse extension extending forwardly from the sloped partition in the water reservoir so as to define a shallow water portion thereon;

a seat assembly disposed on the closed top of the bowl, said seat assembly comprising:

a seat having a flat odor protection portion, a front end, a rear end, first upright projected upwardly from said front end engageable with the urine protector, a second opening and a second saddle portion abutting the first upright, a knuckle member centrally extending outwardly from the rear end thereof, a positioning plate extending outwardly from the knuckle member and a pair of screw holes formed spaced apart in the positioning plate engageable with the pair of securing holes for fastening the seat onto the bowl by means of bolts inserted through said window;

a cover hinged with the seat and having a flat portion, a front end, a rear end, a second upright projected upwardly from the front end and engageable with the first upright, a third saddle portion abutting the third upright and being engageable with second saddle portion and a pair of lug members extending spaced apart and outwardly from the rear end thereof for attachment of the cover to the knuckle member of the seat by a threaded pin and a nut.

* * * * *